US007469441B2

(12) United States Patent
Hirse

(10) Patent No.: US 7,469,441 B2
(45) Date of Patent: Dec. 30, 2008

(54) FLOOR MOP

(75) Inventor: Gernot Hirse, Neu-Isenburg (DE)

(73) Assignee: Carl Freudenberg KG, Weinheim (DE)

( * ) Notice: Subject to any disclaimer, the term of this patent is extended or adjusted under 35 U.S.C. 154(b) by 602 days.

(21) Appl. No.: 10/432,652

(22) PCT Filed: Nov. 23, 2001

(86) PCT No.: PCT/EP01/13670

§ 371 (c)(1),
(2), (4) Date: Sep. 22, 2003

(87) PCT Pub. No.: WO02/41744

PCT Pub. Date: May 30, 2002

(65) Prior Publication Data

US 2004/0060140 A1 Apr. 1, 2004

(30) Foreign Application Priority Data

Nov. 24, 2000 (DE) ..... 100 58 510
Nov. 25, 2000 (DE) ..... 100 58 630

(51) Int. Cl.
*A47L 13/146* (2006.01)

(52) U.S. Cl. ..... 15/119.2; 15/244.2; 15/228

(58) Field of Classification Search ..... 15/119.2, 15/119.1, 116.1, 116.2, 244.2, 228, 244.1
See application file for complete search history.

(56) References Cited

U.S. PATENT DOCUMENTS 2,730,744 A * 1/1956 Vaugha ..... 15/119.2
2,892,201 A * 6/1959 Peterson et al. ..... 15/119.2
3,224,025 A 12/1965 Altrock ..... 15/119
4,831,677 A 5/1989 Morrison et al. ..... 15/119
5,272,783 A * 12/1993 Richardson et al. ..... 15/119.2
5,483,720 A 1/1996 Decoopman et al. ..... 15/119.2
5,488,750 A * 2/1996 Vosbikian et al. ..... 15/119.2
5,625,918 A 5/1997 Kieson et al. ..... 15/119.2
5,896,613 A 4/1999 Courtney et al. ..... 15/119.2
5,926,896 A 7/1999 Allemann et al. ..... 15/147.2
6,119,297 A * 9/2000 Ohm et al. ..... 15/119.2
6,330,084 B1 * 12/2001 Chiang ..... 358/497
6,418,585 B1 * 7/2002 Viner ..... 15/119.2
6,675,426 B2 * 1/2004 Ohm et al. ..... 15/119.2
6,854,150 B2 * 2/2005 Hirse ..... 15/119.2

FOREIGN PATENT DOCUMENTS

AT 365441 3/1976

(Continued)

*Primary Examiner*—Gary K Graham
(74) *Attorney, Agent, or Firm*—Davidson, Davidson & Kappel, LLC

(57) ABSTRACT

A floor mop has two mop supporting wings, which carry an absorbent mop layer and are hinge-connected to a common supporting centerpiece. A mop handle is hinge-mounted to the supporting centerpiece via a Cardan joint. A squeezing slider, which is displaceable along the mop handle and is guided non-rotatably, has two rigid squeezing arms whose ends can each be brought into engagement with a guide surface on the upper side of the respectively assigned mop supporting wings via rollers. Each mop supporting wing forms a rectangular trapezium or triangle. The edges running at right angles to the hinge edge of each mop supporting wing form a common straight continuous front edge.

20 Claims, 5 Drawing Sheets

FOREIGN PATENT DOCUMENTS

| | | | |
|---|---|---|---|
| BE | 496850 | | 11/1950 |
| DE | 600206 | | 7/1934 |
| DE | 4222948 | | 2/1993 |
| DE | 29920659 | | 11/1999 |
| WO | 9608991 | | 3/1996 |
| WO | 9806316 | | 2/1998 |
| WO | 9909876 | | 3/1999 |
| WO | WO 99/09876 | * | 3/1999 |

* cited by examiner

FLOOR MOP

BACKGROUND

The invention relates to a floor mop comprising two mop supporting wings which carry an absorbent mop layer and are hinge-connected to a mop handle and comprising a squeezing slider which is displaceable along the mop handle and has two rigid squeezing arms whose ends can each be brought into engagement with a guide surface on the back side of the respectively assigned mop supporting wings.

Floor mops comprising two mop supporting wings which can be hinged towards one another to squeeze out the mop layer, also known as a butterfly floor mop, are known in various designs. In the floor mops according to U.S. Pat. No. 5,483,720 and International Patent Application PCT/US95/10759, a sleeve displaceable along the mop handle is connected via a guide rod to two clamps pivotally supported on the supporting centerpiece, which on displacement of the sleeve, slide along on the back side of the two mop supporting wings and thereby press these together. In this case, the mop handle must however be rigidly connect to the supporting centerpiece. As a result of this rigid connection, the possible usage of the floor mop is limited because only a specific oblique position of the mop handle with respect to the mop supporting wings is predetermined in their working position.

In another known floor mop of the genre specified initially, the ends of the squeezing arms connected rigidly to the squeezing slider are each connected rigidly via a guide rod to the back side of each mop supporting wing. When the squeezing slider on the mop handle is displaced downwards, the two guide rods act as hinged props which press the two mop supporting wings towards one another in order to squeeze out the mop layer located therebetween. In this case also, the angular position of the mop handle with respect to the mop supporting wings is predetermined in the working position so that the possible usage is limited.

In a known floor mop (U.S. Pat. No. 5,625,918) the mop handle is rigidly connected to a supporting centerpiece of an essentially triangular carrier plate whose two side sections form hinged mop supporting wings. For squeezing out there is hinged downwards a wire bracket which acts on the two mop supporting wings via two squeezing rollers. The attainable squeezing forces are thus only relatively small. The mop carrier has a projecting corner on its front side and can thus only be guided along a straight floor boundary with one of its oblique side edges.

In another known floor mop (U.S. Pat. No. 3,224,025) the mop handle is hinge-connected to the two mop supporting wings which are directly pivotally connected one to the other. The squeezing slider consists of a sleeve which is displaceable along the mop handle and is longitudinally slotted in its lower section, into which the two mop supporting wings are inserted in the folded-together state. The two sleeve sections separated one from the other by the longitudinal slot each act via a roller on a guide surface on the back side of the respectively assigned mop supporting wing. As a result of the direct hinged connection of the two mop supporting wings and the small mutual spacing of the two rollers, the squeezing process is very difficult, at least at the beginning. In this case also, the mop supporting surface has a projecting corner on its front side so that it can only be moved along a straight floor boundary with oblique side edges.

In known floor mops (German Patent Document DE 42 22 948 A1) the mop supporting wings are rectangular-shaped. The water level in the cleaning bucket required to rinse out the mop must thus be selected at least so that the rectangular mop supporting wings, which for ergonomic reasons are usually inserted obliquely into the cleaning bucket, are completely immersed in the cleaning water. In the case of rectangular mop supporting wings, this minimum level of the cleaning water is relatively high so that a relatively large quantity of water must be provided in the cleaning bucket so that the cleaning bucket is heavy.

The maximum force needed to squeeze out the mop is substantially determined by the pivoting moment at the end of the pivoting movement required to pivot the mop supporting wings. Here the surface areas furthest away from the pivot axis make the largest contribution to the squeezing moment since these surface areas furthest away therefrom each act with the largest lever arm. Thus, lever transmissions must be provided at the squeezing devices in order to apply the required squeezing moment at the end of the squeezing movement.

SUMMARY OF THE INVENTION

An object of the present invention is thus to develop a floor mop that is easy to handle and easy to squeeze out and manages with a lower cleaning water level.

The present invention provides a floor mop that includes a grip handle that is hinge-connected to a supporting centrepiece to which the two mop supporting wings are pivotally mounted with a hinge edge. Each mop supporting wing forms a rectangular trapezium or triangle whose larger base line forms the hinge edge and the two edges of the mop supporting wings running at right angles to the hinge edge form a common, straight, continuous front edge of the floor mop.

Each mop supporting wing is thus broader at its hinge edge than at its edge opposite the hinge edge. Thus, compared with a rectangular mop supporting wing, its width and therefore also its area decrease with increasing distance from the pivot axis at the hinge edge. Thus, those surface areas which act with a large lever arm are reduced. In this fashion the required maximum squeezing moment is also reduced so that the floor mop can be squeezed out with a smaller force. Working with the floor mop is therefore less strenuous.

The sloping arrangement of the one side edge and the consequent deviation from a rectangular surface of the mop supporting wing has the result that a lower water level is required for a complete immersion of the mop in the cleaning water. For the same total area of the floor mop its depth of immersion is reduced in the oblique position of the floor mop usually used for ergonomic reasons. For the same depth of water a broader cleaning strip is obtained for the same expenditure of force.

The smaller width at the ends of the two mop supporting wings also has the result that the floor mop can be inserted more easily into narrow corners and gaps so that a more thorough cleaning action can be achieved even in the more inaccessible areas of the floor area to be cleaned. Obstacles on the floor can also be avoided more easily.

Each mop supporting wing preferably forms a rectangular trapezium whose larger base line forms the hinge edge. In its outspread position on the floor the mop thus has one continuous front edge containing the two rectangular side edges and two narrower ends which can ultimately become a corner so that each mop supporting wing forms a triangle.

The continuous straight front edge of the floor mop allows this to be brought forward as far as a straight boundary edge of the floor to be mopped, running transverse to the working direction.

The squeezing action via sufficiently stable squeezing arms arranged a sufficient distance apart produces a thorough squeezing on the mop supporting wings hinge-mounted on the supporting centerpiece without the force to be expended herefor being too high at the beginning of the squeezing process.

The mop handle is more suitably connected to the supporting centerpiece via a Cardan joint and the ends of the squeezing arms can be brought into engagement with a guide surface on the back side of the respectively assigned mop supporting wing. The squeezing slider is in this case guided non-rotatably on the mop handle.

According to a preferred embodiment of the invention it is provided that the guide surface of each mop supporting wing ascends in the direction of the free end of the plate towards an elevation projecting from this back side of the mop supporting wing. By this means an intensified concluding pressing together of the mop supporting wings is accomplished at the end of the squeezing movement.

The guide surface preferably slopes down towards the mop supporting wing on the side of the elevation facing the free end of the plate. It is thereby achieved that the force to be applied to the squeezing slider after passing over the elevations decreases at the end of the squeezing process and thus gives the user a clear indication that the squeezing process has been completely accomplished and terminated.

BRIEF DESCRIPTION OF THE DRAWINGS

Exemplary embodiments of the invention are shown in the drawings and are explained in detail below. In the drawings.

DETAILED DESCRIPTION

Figure 3:
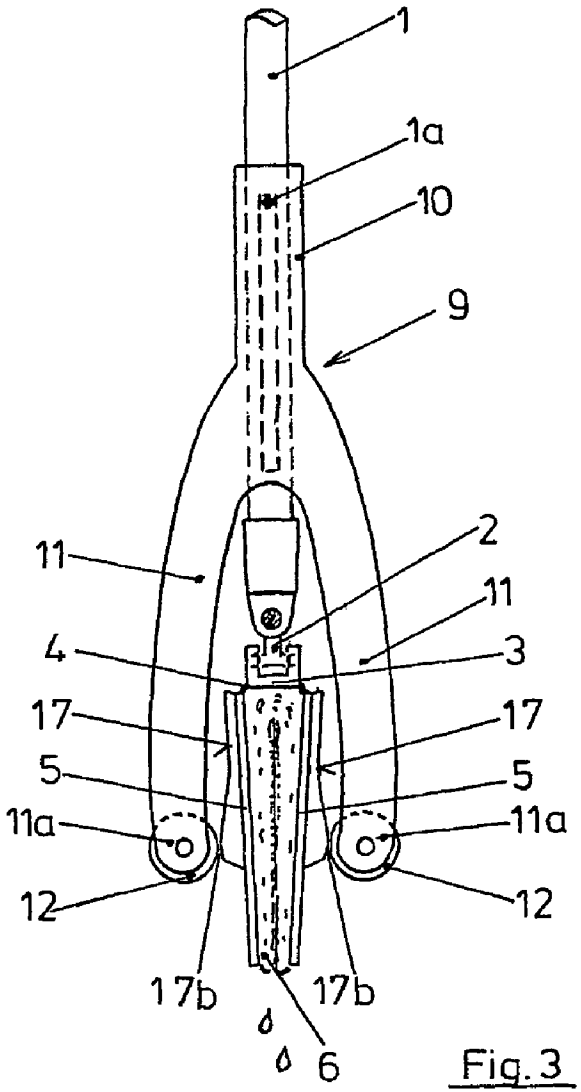
FIG. 3 shows the floor mop from FIGS. 1 and 2 at the end of the squeezing process.
Figure 1:
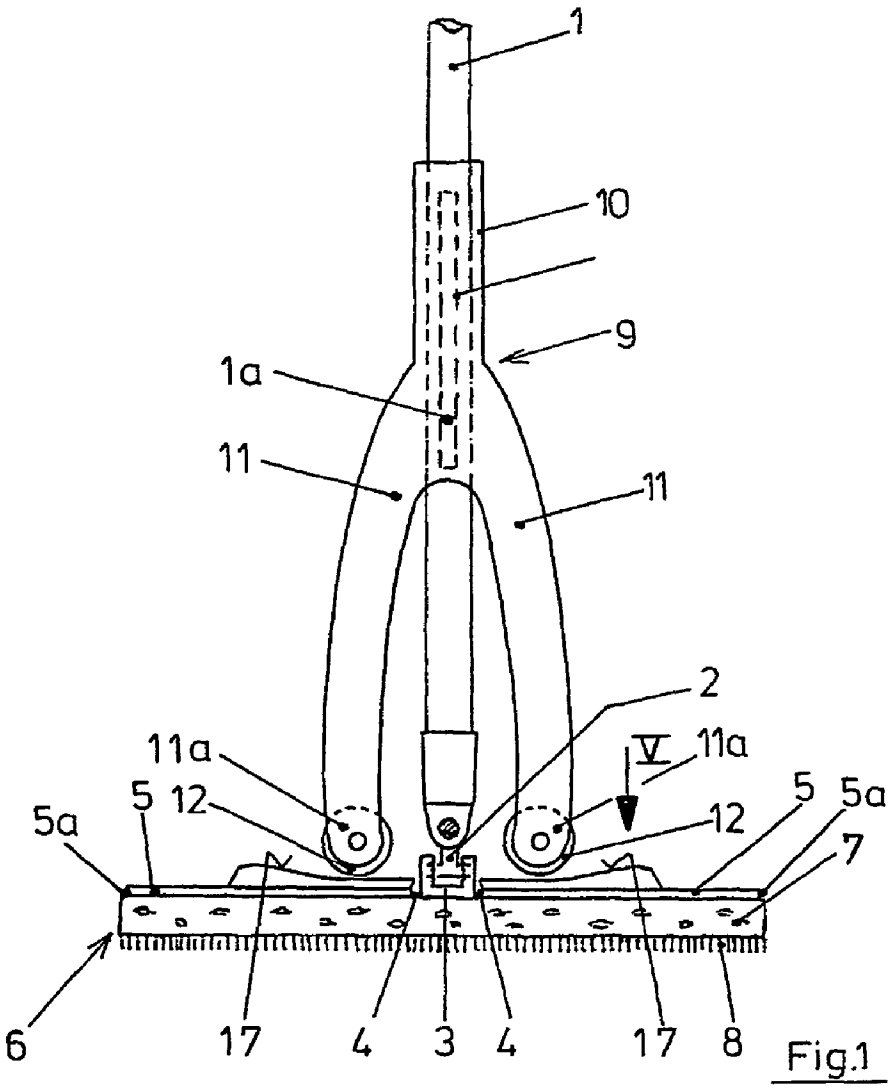
FIG. 1 shows a side view of a floor mop in its working position.

The floor mop shown in FIGS. 1-5 has a mop handle 1 which is connected via a Cardan joint 2 to a supporting centerpiece 3 non-rotatably but pivotally in all directions. The supporting centerpiece 3 is connected via hinges 4 attached on both sides to a mop supporting wing 5.

The two mop supporting wings 5 and the supporting centerpiece 3 carry an absorbent, squeezable mop layer 6 which in the conventional fashion consists of a sponge layer 7 and a gauze coating 8.

A squeezing slider 9 is displaceable along the mop handle 1. The squeezing slider 9 has a guide sleeve 10 which is guided non-rotatably, longitudinally displaceably along the mop handle 1. For example, in the hole of the sleeve 10 there is provided a longitudinal groove into which a pin 1 a attached to the mop handle 1 engages.

The sleeve 10 is rigidly connected to two squeezing arms 11 which each carry a rotatably supported roller 12 as rotatable rollers at their ends 11*a* in the exemplary embodiment shown in FIGS. 1-5.

Figure 6:
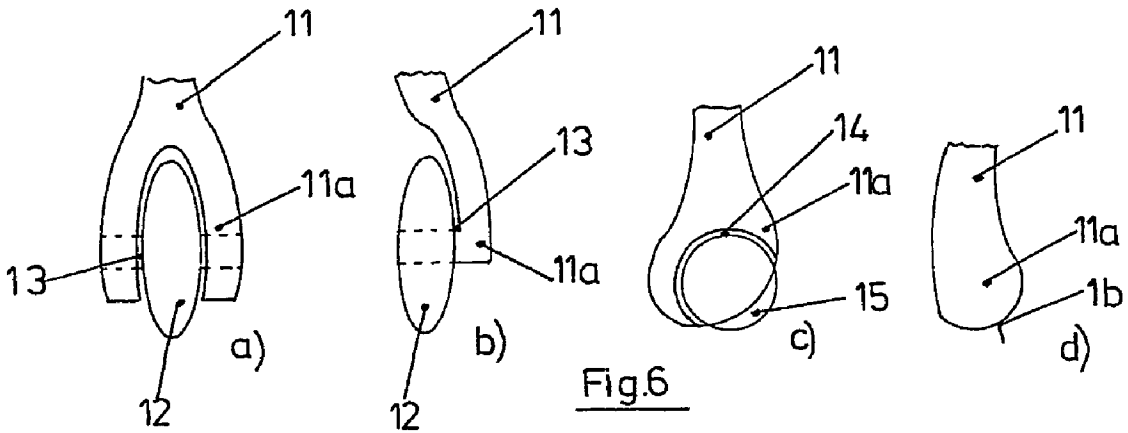
Figure 5:
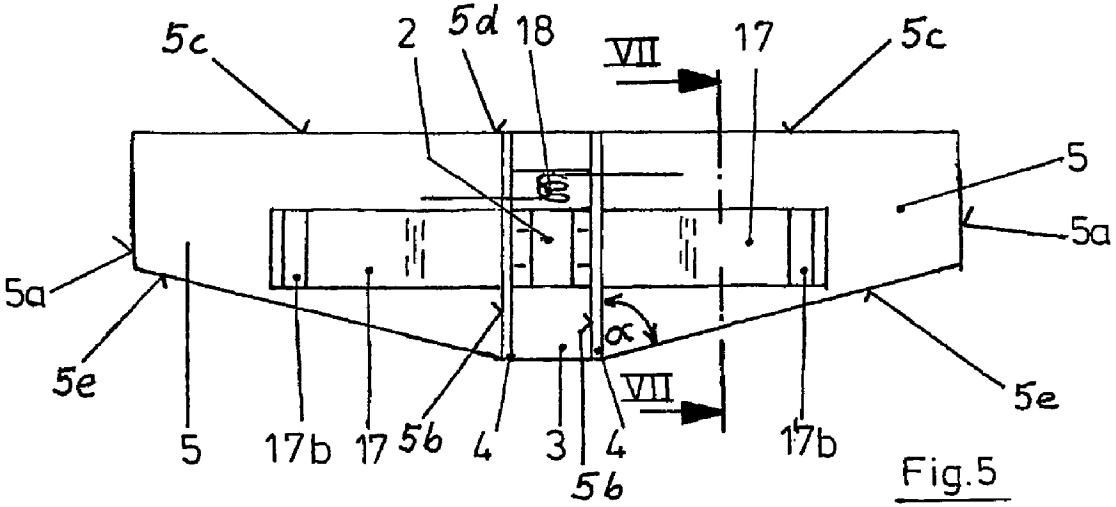
FIG. 5 shows a top view in the direction of the arrow V in FIG. 1 where the mop handle and the squeezing slider have been omitted, FIG. 6*a*)-*d*) shows part views of different embodiments of the roller body or the arched pressure surface at the end of a pressing arm.

It is shown in FIG. 6 that the roller 12 is supported on an axle 13 which can be attached to the squeezing arm 11 on both sides (FIG. 6*a*) or on one side (FIG. 6*b*). Instead, it is also possible (FIG. 6*c*) to provide a sphere 15 rotatably accommodated in a recess 14 at the end 11*a* of the squeezing arm 11 as a roller body. Another possible alternative consists in the end 11*a* of each squeezing arm 11 having a convexly arched pressure surface 1*b* (FIG. 6*d*).

Figure 2:
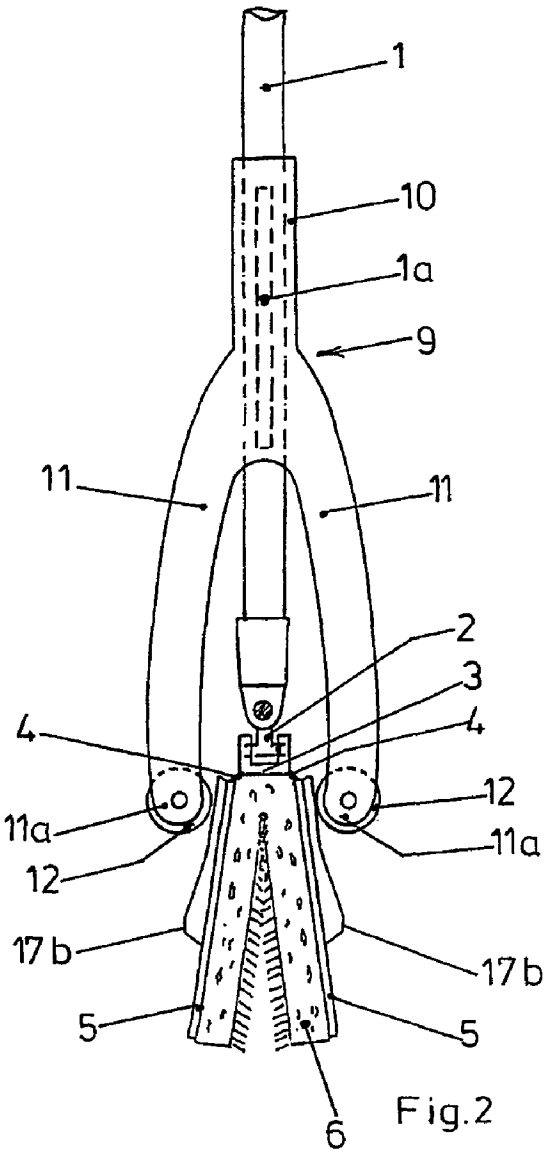
FIG. 2 shows the floor mop from FIG. 1 at the beginning of the squeezing process.
Figure 7:
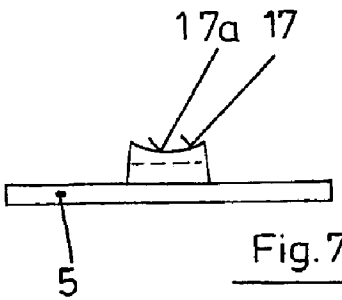
FIG. 7 shows a section along the line VII-VII in FIG. 5.
Figure 13:
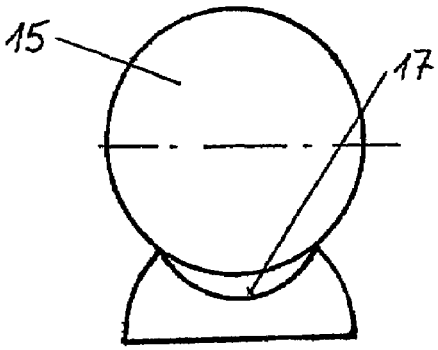
Figure 14:
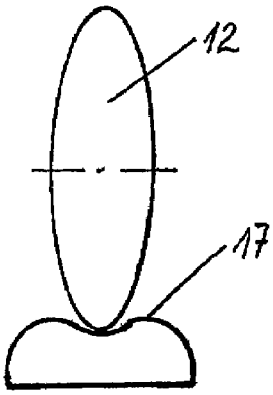

When the squeezing slider 9 is moved downwards to initiate a squeezing process on the mop handle 1, the rollers 12 (or in comparable fashion the sphere 15 or the arched pressure surface 1*b*) each come into engagement with a guide surface 17 on the back side of the respectively assigned mop supporting wing 5. By this means the two mop supporting wings 5 are pivoted towards one another, as shown in FIG. 2 at the beginning of the squeezing process. For better guidance of the rollers 12, the sphere 15 or the pressure surface 16, the guide surface 17 can each have a flat longitudinal groove 17*a* which is concave in cross-section (FIGS. 7, 13 or 14).

The two guide surfaces 17 on the back of each mop supporting wing 5 ascend in the direction of the free end of the wing 5*a* towards an elevation 17*b* which projects from the back side of the mop supporting wing 5 and then slopes down again towards the free end of the wing 5*a*.

At the end of the squeezing process shown in FIG. 3, the rollers 12 have reached these elevations 17*b* whereby the two mop supporting wings 5 are folded towards one another in their utmost squeezing position. In can be provided that the rollers 12 go slightly beyond the elevations 17*b* so that a decrease in the feeding force to be expended on the squeezing slider 9 gives the user a feeling that the end point of the squeezing process has been surpassed.

From this squeezing position (FIG. 3) the squeezing slider 9 is pulled back into its initial position. In this case, the two mop supporting wings 5 are moved into their elongated position by means of a spring device, for example an operating lever spring 18 (FIG. 5) whose legs are connected to the mop supporting wings 5. The hinges of the mop supporting wings 5 are designed so that the mop supporting wings 5 cannot be folded upwards beyond their elongated alignment.

Figure 4:
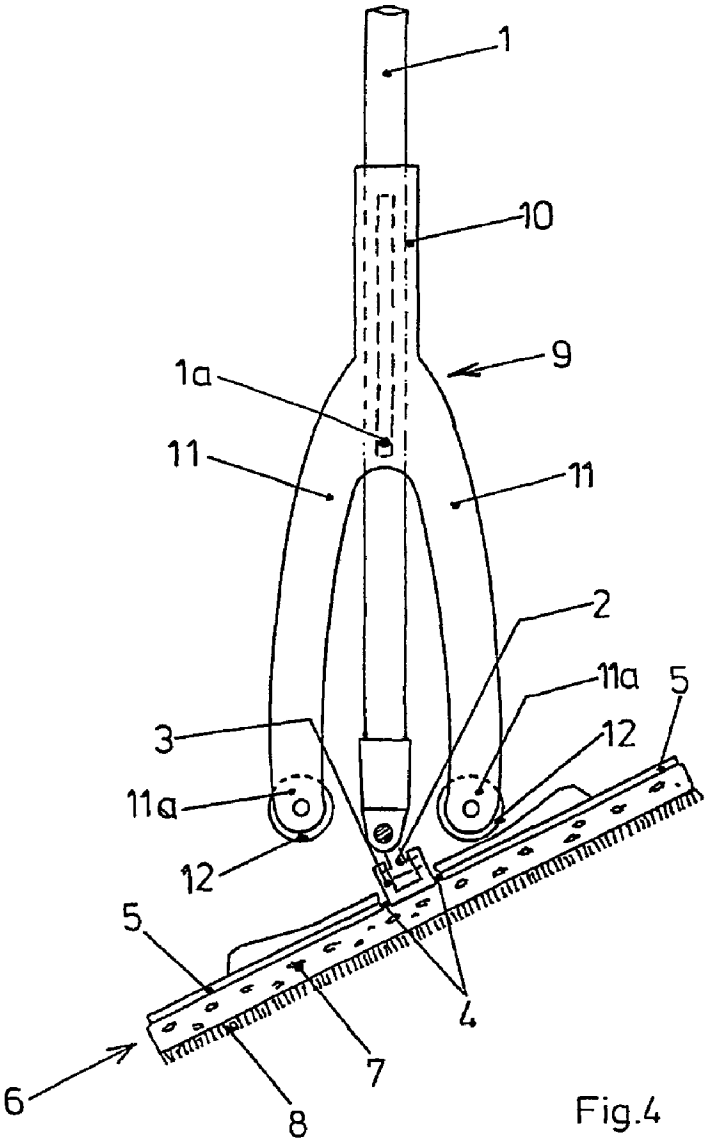
FIG. 4 shows the floor mop from FIGS. 1-3 in its working position with the mop handle inclined laterally at an angle

FIG. 4 shows that the squeezing slider 9 can be moved back so far that the two rollers 12 release the mop supporting wings 5 so far that these can be swivelled sufficiently to the side, as shown in FIG. 4.

Figure 8:
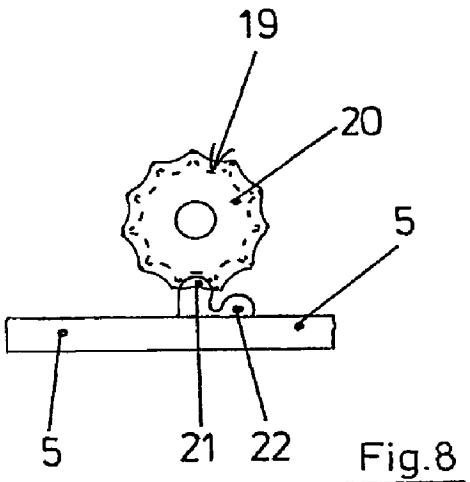
FIG. 8 shows a simplified part view of a modified embodiment of the roller body at the end of the squeezing arm.

FIG. 8 shows another modified embodiment in which the roller body on the squeezing arm 11 is a wheel 20 provided with recesses 19 on the circumference, which enters into engagement with at least one projection 21 or 22 on the back side of the mop supporting wing 5 at the end of the squeezing process.

Each of the two mop supporting wings 5 forms a rectangular trapezium. The hinge edge 5*b* in each case forms the larger base line of the trapezium. A rear edge 5*e* of each mop supporting wing 5 runs at an acute angle to the hinge edge 5*e* which forms the hinge 4 and is inclined towards the front edge 5*c* which runs at right angles to the hinge edge 5*b*.

Figure 11:
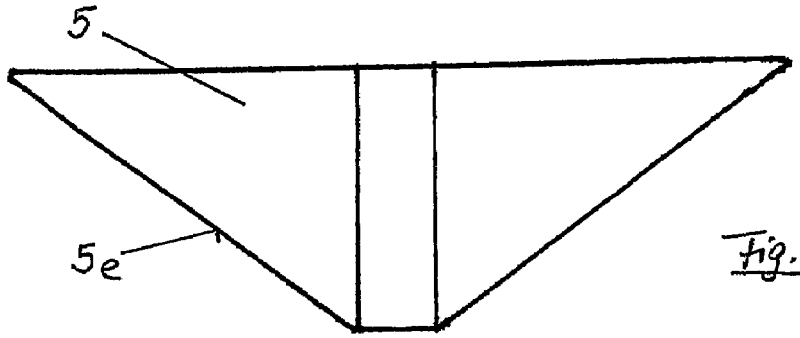

The free edge 5*a* of each mop supporting wing 5 lying opposite the hinge edge 5*b* thus forms the smaller base line of the trapezium. Each mop supporting wing 5 is substantially narrower in the area of its free edge 5*a* than in the area of its hinge edge 4. The edge 5*a* can also be reduced in size as far as a point so that the plan form of the mop supporting wing 5 forms a triangle (FIG. 11). With a slight increase in the required pressure, a further substantial increase in the mopping width is thereby obtained without any increase in the immersion depth.

The two edges 5*c* of the mop supporting wings 5 running at right angles to the hinge edge 5*b* form a common straight, continuous front edge 5*d* of the floor mop.

Figure 15:
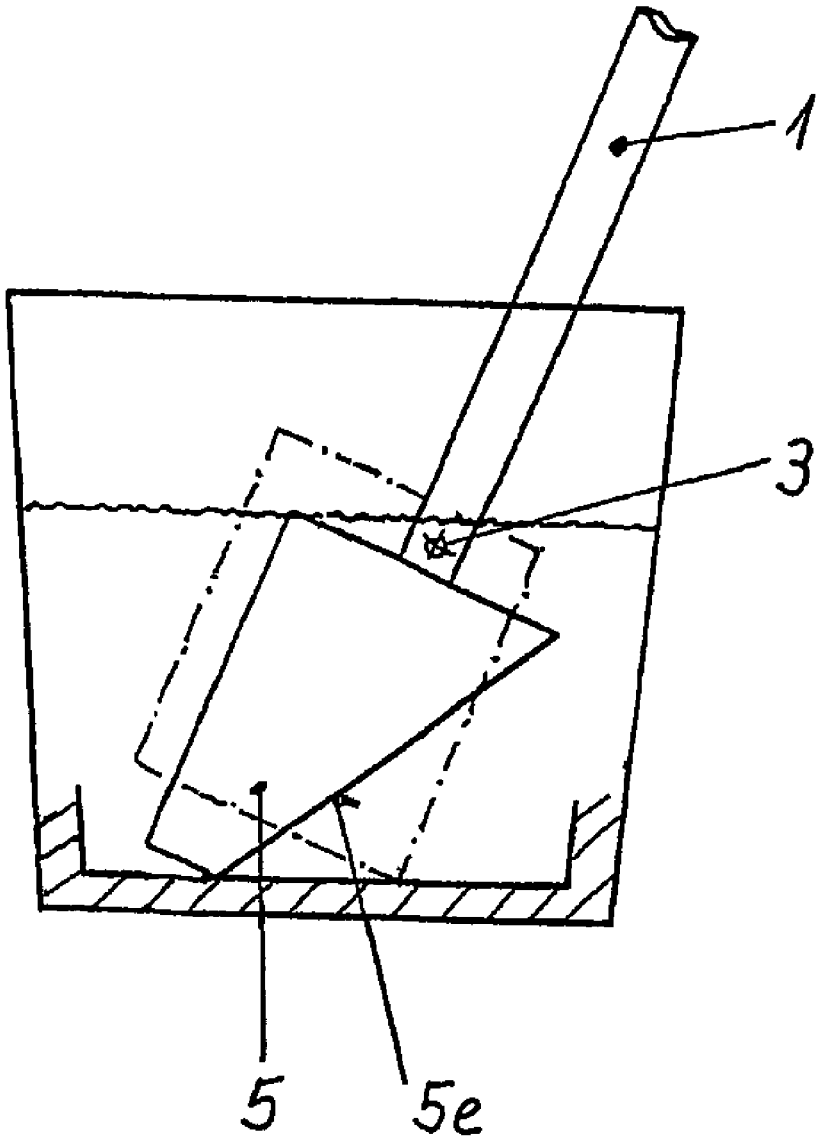
FIG. 15 shows the arrangement of the floor mop in a bucket.

Compared with a floor mop having rectangular mop supporting wings, the floor mop shown with a sloping rear edge 5*e* manages with a lower water level in the cleaning bucket. In the usual oblique position shown in FIG. 15 the immersion depth of the floor mop is smaller than for rectangular mop supporting wings.

Figure 9:
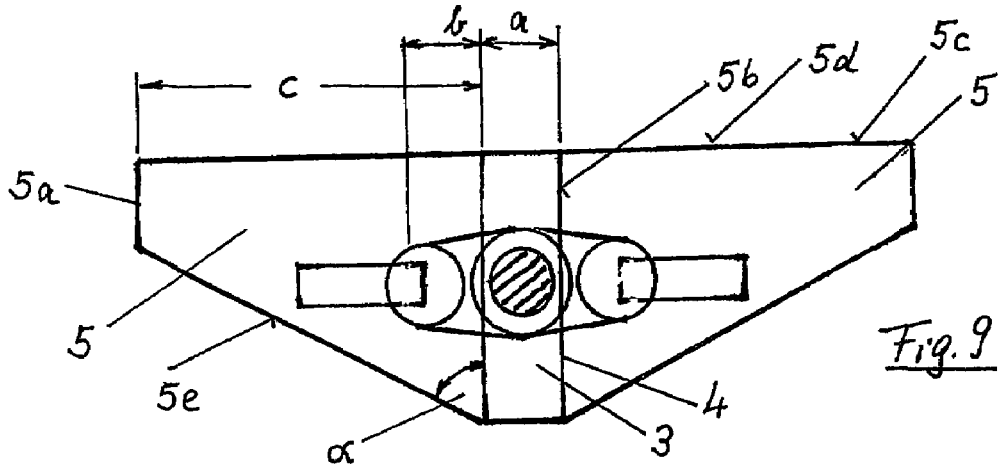
FIGS. 9, 10 and 11 show different plan forms of the floor mop each in views similar to FIG. 5, FIGS. 12, 13 and 14 show different embodiments of the roller body and its rolling surfaces.
Figure 10:
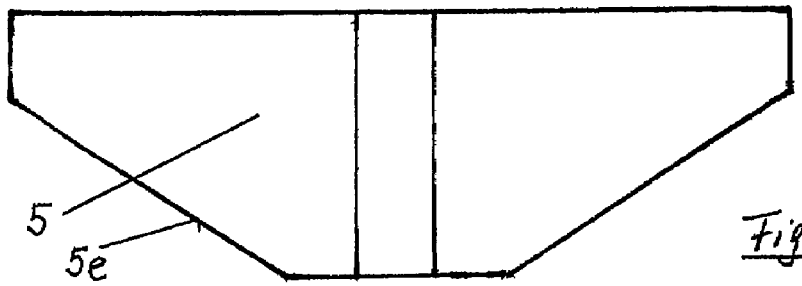

It is shown in FIG. 9 that the distance b between the point of application of the squeezing arm 11 on the guide surface 17 and the hinge edge 5*b* is at least the same as the width a of the supporting centerpiece 3.

The distance b between the point of application of the squeezing arm 11 and the hinge edge 5*b* is at least ⅕ the width c of the mop supporting wing 5.

The mop handle 1 engages in the longitudinal center of the supporting centerpiece 3. Instead, the mop handle 1 can also be offset from the longitudinal center of the supporting centerpiece 3 towards the front edge 5*d*. The sloping rear edge 5*e* of each mop supporting wing 5 forms an angle $\alpha$ of 50°-70° with the hinge edge 5*b*.

Figure 12:
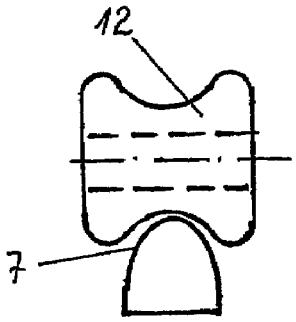

The roller 12 can have a circumferential groove which runs on the bulging guide surface 17 (FIG. 12). With a channel shaped guide surface 17 (FIG. 13), the sphere 15 of the squeezing arm 11 can run on the longitudinal edges of the channel. A disk-shaped roller body 12 (FIG. 14) can roll on the base of a channel-shaped guide surface 17.

The invention claimed is:

1. A floor mop comprising:

a mop handle;

an absorbent mop layer;

a supporting centerpiece pivotably connected to the mop handle;

two mop supporting wings carrying the mop layer, each of the two mop supporting wings having a hinge edge pivotably connected to the centerpiece, a wing front edge at a right angle to the hinge edge, and an upper side including a guide surface, the wing front edges forming a common straight mop front edge of the floor mop in an elongated position of the two mop supporting wings, each of the mop supporting wings forming a trapezoid or a triangle;

a squeezing slider displaceable along the mop handle;

two rigid squeezing arms each having a first end engageable with a respective one of the guide surfaces;

wherein each mop supporting wing includes a free wing end opposite the hinge edge;

wherein each of the guide surfaces includes an upward slope in the direction of the free wing end toward an elevation projecting from the upper side of the mop supporting wing;

wherein each guide surface further includes a downward slope on a side of the elevation facing the free wing end;

wherein the first end of each squeezing arm includes a rotatable roller body; and wherein the upper side of the mop supporting wing includes a projection, and wherein the roller body includes a wheel engageable with the projection, the wheel having a circumference and a plurality of recesses on the circumference.

2. The floor mop as recited in claim 1 wherein each of the mop supporting wings forms the trapezoid, the trapezoid having a longer base forming the hinge edge and a shorter base parallel to the longer base.

3. The floor mop as recited in claim 1 wherein each of the mop supporting wings forms a right triangle having a first leg forming the hinge edge and a second leg forming the front wing edge.

4. The floor mop as recited in claim 1 further comprising a Cardan joint connecting the mop handle to the supporting centerpiece and wherein the squeezing slider is guided non-rotatably on the mop handle.

5. The floor mop as recited in claim 1 further comprising a spring device for moving the two mop supporting wings into the elongated position.

6. The floor mop as recited in claim 1 wherein the roller body is a roller rotatably supported on a portion of the squeezing arm.

7. The floor mop as recited in claim 1 wherein the first end of each squeezing arm includes a convex pressure surface.

8. The floor mop as recited in claim 1 wherein a first end of each of the squeezing arms engages a respective one of the guide surfaces at an engagement point, a distance between the engagement point and the respective hinge edge being equal to or greater than a width of the supporting centerpiece.

9. The floor mop as recited in claim 1 wherein a first end of each of the squeezing arms engages a respective one of the guide surfaces at an engagement point, a distance between the engagement point and the respective hinge edge being at least ⅕ a distance from the hinge edge to an opposite edge of the respective mop supporting wing.

10. The floor mop as recited in claim 1 wherein each of the mop supporting wings includes a rear edge forming an angle of 50°-70° with the hinge edge.

11. A floor mop comprising:

a mop handle;

an absorbent mop layer;

a supporting centerpiece pivotably connected to the mop handle;

two mop supporting wings carrying the mop layer, each of the two mop supporting wings having a hinge edge pivotably connected to the centerpiece, a wing front edge at a right angle to the hinge edge, and an upper side including a guide surface, the wing front edges forming a common straight mop front edge of the floor mop in an elongated position of the two mop supporting wings, each of the mop supporting wings forming a trapezoid or a triangle;

a squeezing slider displaceable along the mop handle;

two rigid squeezing arms each having a first end engageable with a respective one of the guide surfaces;

wherein each mop supporting wing includes a free wing end opposite the hinge edge;

wherein each of the guide surfaces includes an upward slope in the direction of the free wing end toward an elevation projecting from the upper side of the mop supporting wing;

wherein each guide surface further includes a downward slope on a side of the elevation facing the free wing end;

wherein the first end of each squeezing arm includes a rotatable roller body; and wherein the guide surface includes a flat longitudinal groove with a concave cross- section.

12. The floor mop as recited in claim 11 wherein each of the mop supporting wings forms the trapezoid, the trapezoid having a longer base forming the hinge edge and a shorter base parallel to the longer base.

13. The floor mop as recited in claim 11 wherein each of the mop supporting wings forms a right triangle having a first leg forming the hinge edge and a second leg forming the front wing edge.

14. The floor mop as recited in claim 11 further comprising a Cardan joint connecting the mop handle to the supporting centerpiece and wherein the squeezing slider is guided non-rotatably on the mop handle.

15. The floor mop as recited in claim 11 further comprising a spring device for moving the two mop supporting wings into the elongated position.

16. The floor mop as recited in claim 11 wherein the roller body is a roller rotatably supported on a portion of the squeezing arm.

17. The floor mop as recited in claim 11 wherein the first end of each squeezing arm includes a convex pressure surface.

18. The floor mop as recited in claim 11 wherein a first end of each of the squeezing arms engages a respective one of the guide surfaces at an engagement point, a distance between the engagement point and the respective hinge edge being equal to or greater than a width of the supporting centerpiece.

19. The floor mop as recited in claim 11 wherein a first end of each of the squeezing arms engages a respective one of the guide surfaces at an engagement point, a distance between the engagement point and the respective hinge edge being at least ⅕ a distance from the hinge edge to an opposite edge of the respective mop supporting wing.

20. The floor mop as recited in claim 11 wherein each of the mop supporting wings includes a rear edge forming an angle of 50°-70° with the hinge edge.

* * * * *